United States Patent [19]

Okabe et al.

[11] 4,394,331

[45] Jul. 19, 1983

[54] CARBURETOR

[75] Inventors: Yousuke Okabe, Niiza; Osamu Shoji, Kawagoe, both of Japan

[73] Assignee: Honda Giken Kogyo Kabushiki Kaisha, Tokyo, Japan

[21] Appl. No.: 238,632

[22] Filed: Nov. 6, 1981

[51] Int. Cl.[3] ..... F02M 1/16

[52] U.S. Cl. ..... 261/18 B; 261/44 C; 261/DIG. 8

[58] Field of Search ..... 261/18 B, 44 C, DIG. 8

[56] References Cited

U.S. PATENT DOCUMENTS

| | | | |
|---|---|---|---|
| 2,643,647 | 6/1953 | Meyer et al. | 261/18 B |
| 3,764,120 | 10/1973 | Imai | 261/44 C |
| 4,347,195 | 8/1982 | Ogawa | 261/18 B |

*Primary Examiner*—Tim R. Miles

*Attorney, Agent, or Firm*—Armstrong, Nikaido, Marmelstein & Kubovcik

[57] ABSTRACT

A carburetor for internal combustion engines adapted to operate normally with an alcoholic fuel. The carburetor has a slow fuel passage communicating with an idle port and a by-pass port both of which open to an intake bore at a portion of the latter around a throttle valve, a cup-shaped member disposed in a float chamber at a level beneath the level of the fuel in the float chamber and defining therein a downwardly opened space. A primary jet leading to a primary nozzle and a secondary jet leading to a secondary nozzle, which are known per se, are arranged to open, respectively, to an uppermost portion and an intermediate portion of the space in the cup-shaped member. The float chamber is communicated through a float valve of the known type with a main fuel tank storing an alcoholic fuel as the main fuel, while the space in the cup-shaped member is communicated, through a metering pump, with an auxiliary fuel tank storing therein gasoline as the starting fuel.

1 Claim, 1 Drawing Figure

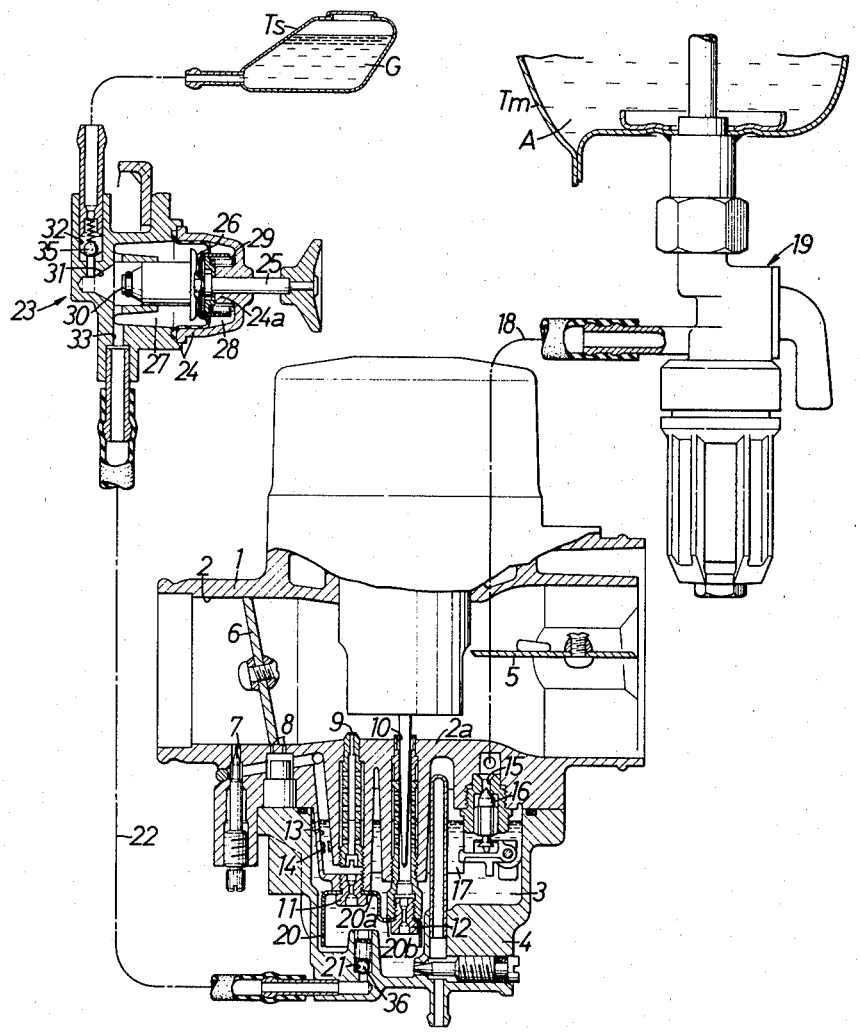
Ts
G
Tm
A
19
18
32
35
31
23
30
33
26
29
25
24a
28
27
24
2
1
6
5
7
8
9
10
2a
15
16
13
14
17
3
11
20a
12
20
20b
4
21
36
22

CARBURETOR

BACKGROUND OF THE INVENTION

The present invention relates to a carburetor for use in internal combustion engines which operate with alcoholic fuel.

Since the alcoholic fuel is less volatile than gasoline, it is difficult to start an internal combustion engine with the alcoholic fuel particularly when the ambient temperature is low.

SUMMARY OF THE INVENTION

It is, therefore, an object of the invention to provide a carburetor for use in internal combustion engines which operate with alcoholic fuel, capable of starting the engine without fail even when the ambient temperature is low, thereby to overcome the above described problem of the prior art.

To this end, according to the invention, there is provided a carburetor in which a small amount of gasoline as the starting fuel is supplied to the float chamber of the carburetor to ensure a safe start up of the engine as well as subsequent loaded operation of the engine by an efficient use of the starting fuel.

BRIEF DESCRIPTION OF THE DRAWING

The attached sole FIGURE is a vertical sectional side view of a carburetor constructed in accordance with an embodiment of the invention.

DESCRIPTION OF THE PREFERRED EMBODIMENT

A preferred embodiment of the invention will be described hereinunder with reference to the accompanying drawings.

Referring to the drawings, a reference numeral 1 denotes the body of a carburetor having a central intake bore 2 formed horizontally therein. A vessel 4 defining a float chamber 3 is secured to the lower part of the carburetor body 1. The intake bore 2 has a venturi portion 2*a* formed at a central portion thereof. A choke valve 5 is disposed at the upstream side (right side as viewed in the drawing) of the venturi portion 2*a*, while a throttle valve 6 is disposed at the downstream side of the same. An idle port 7 opens to the intake bore 2 at a portion of the latter somewhat downstream from the throttle valve 6. A by-pass port 8 opens at a portion in the close proximity of the throttle valve 6. Also, a primary nozzle 9 and a secondary nozzle 10 open to the intake bore 2, respectively, at a portion between the throttle valve 6 and the venturi portion 2 and at the venturi portion 2*a*. The primary nozzle 9 and the secondary nozzle 10 are communicated with the float chamber 3 through a primary jet 11 and a secondary jet 12, respectively. A slow fuel passage 13 shunting from the portion between the primary nozzle 9 and the primary jet 11 leads to the idle port 7 and the by-pass port 8. A slow jet 14 is disposed in the slow fuel passage 13.

A main fuel supply port 15 opens in the upper side of the float chamber 3. A float valve 16 which is known per se is disposed in the opening of the main fuel supply port 15. The float valve 16 operates to open and close the main fuel supply port 15, in cooperation with a float 17 disposed in the float chamber 3, so as to maintain a predetermined level of fuel in the float chamber 3. A fuel passage 18 leading from the main fuel tank Tm is connected to the main fuel supply port 15. A well-known fuel cock 19 capable of taking three positions of ON, OFF and RESERVE is disposed in the fuel passage 18. An alcoholic fuel as the main fuel is stored in the main fuel tank Tm.

In the float chamber 3, a cup-shaped member 20 is secured to the lower end of the body 1 of the carburetor, making use of the primary and secondary jets 11,12 screwed to the body 1, with its opening directed downwardly. The cup-shaped member 20 has an upper wall which is stepped into two stages. The primary jet 11 and the secondary jet 12 open in the upper stage 20*a* and the lower stage 20*b*, respectively, of the upper wall of the cup-shaped member 20.

An auxiliary fuel supply port 21 opening into the cup-shaped member 20 is formed in the bottom of the vessel 4. A fuel passage 22 leading from an auxiliary fuel tank Ts is connected to the auxiliary fuel supply passage 21. A fuel metering pump 23 is disposed in the fuel passage 22. The auxiliary fuel tank Ts stores gasoline as the starting fuel.

The metering pump 23 has a pump body 24 having a space divided into a pump chamber 27 and an atmospheric chamber 28 by means of a diaphragm 26 to which connected is an operation rod 25. A preloaded compression spring 29 is disposed in the atmospheric chamber 28 to resiliently bias the diaphragm 26 toward the pump chamber 27. The operation rod 25 is slidably supported by a boss 24*a* formed on the right-side wall of the pump body 24. The boss 24*a* acts also to limit the pulling stroke of the operation rod 25. A valve member 30 is attached to the operation rod 25 across the diaphragm 26. A valve seat 31 for cooperating with the valve member 30 is formed on the left side wall of the pump chamber 27. An inlet port 32 and an outlet port 33 open in the inner wall of the pump chamber with the valve seat 31 interposed therebetween. The pump chamber 27 is communicated with the upstream side portion of the fuel passage 22 through the inlet port 32 and with the downstream side portion of the same through the outlet port 33.

A suction valve 35 and a delivery valve 36 provided in the metering pump 23 are disposed in the aforementioned inlet port 32 and the auxiliary fuel supply port 21, respectively. The suction valve 35 is constructed as being of a normally-opened type valve.

The preferred embodiment of the invention having the construction described heretofore operates in a manner explained hereinunder.

For starting the engine when the ambient temperature is low, the cock 19 is operated to complete the communication through the fuel passage 18 to allow the alcoholic fuel A to flow from the main fuel tank Tm into the float chamber 3 to fill the latter up to a predetermined level.

Then, as the operation rod 25 of the metering pump 23 is pulled as illustrated, the valve member 30 is moved away from the valve seat 31 to open the inlet port 32. Simultaneously, the diaphragm 26 is deflected to right to reduce the pressure in the pump chamber 27, so that the gasoline G from the auxiliary fuel tank Ts is sucked into the pump chamber 27 through the inlet port 32. Then, as the operation rod 25 is released, the diaphragm 26 is deflected back to the left by the resilient force of the spring 29 to increase the pressure in the pump chamber 27, so that the suction valve 35 is closed and the delivery valve 36 is opened. As a result, the gasoline G is discharged from the pump chamber 27 through the delivery port 33 until the valve member 30 is moved to be seated on the valve seat 31 to close the inlet port 32 by a leftward movement of the operation rod 25. The gasoline G is then discharged into the cup-shaped body 20 through the auxiliary fuel supply port 21. In consequence, due to the difference of the specific gravity between the two kinds of fuel A and G, and due to the discharge pressure of the gasoline G, a part of the alcoholic fuel A which has occupied a part of the cup-shaped body 20 is pushed out through the downward opening of the cup-shaped body 20 to raise the level of the fuel in the float chamber 3 above the normal predetermined level. As a result, comparatively pure gasoline is concentrated in the uppermost portion of the space in the cup-shaped body 20, and the concentration of gasoline G in the alcoholic fuel A is gradually decreased toward the lower side of the cup-shaped body 20.

Thereafter, the cranking of the engine is started with the choke valve 5 closed and the throttle valve opened to a suitable fast-idling opening, so that the intake vacuum established as a result of the cranking is strongly imposed on the idle port 7, by-pass port 8 and the primary nozzle 9. Since the primary jet 11 connected to the idle port 7, by-pass port 8 and primary nozzle 9 opens to the uppermost portion of the space in the cup-shaped body 20 where the concentration of the gasoline G is highest, the fuel mainly consisting of the gasoline G is induced through the primary jet 11 and is discharged through the ports 7,8 and the nozzle 9 to form an air-fuel mixture having a high gasoline content. This mixture is then sucked by the engine to smoothly start up the engine.

Soon after the starting of the engine, as the throttle valve 6 is opened to impose the load on the engine, the intake vacuum of the engine is applied gradually to the primary nozzle 9 and then to the secondary nozzle 10, in accordance with the increase of the opening degree of the throttle valve 6, so that the fuel mainly consisting of gasoline G is induced through the primary nozzle 9. Simultaneously, through the secondary nozzle 10 connected to the secondary jet 12 opening at an intermediate portion of the cup-shaped body 20, the mixture fuel consisting of the alcoholic fuel A and the gasoline G is induced. Thus, the content of the mixture fuel supplied to the engine is changed as the throttle valve 6 is opened to greater degree of opening. This change, however, takes place only gradually, so that the transient engine operation after starting up to the loaded operation is conducted in quite a smooth way.

As the fuel in the cup-shaped body 20 is consumed away, the alcoholic fuel A in the float chamber comes into the cup-shaped member 20 from the lower side of the latter to dilute the remaining gasoline G. After a while, the space in the cup-shaped member 20 is occupied solely by the alcoholic fuel A, so that the engine comes to operate with the alcoholic fuel A having no gasoline content.

In starting up of the engine, it is possible to adjust the amount of supply of the gasoline G into the cup-shaped member 20 in accordance with the coldness, i.e. the ambient temperature, by suitably selecting the pulling stroke of the operation rod 25 of the metering pump 23. When the ambient temperature is sufficiently high, it is not necessary to supply the gasoline G.

For evacuating the auxiliary fuel tank Ts for the cleaning or the like purpose, the operation rod 25 is pulled after detaching of the downstream end of the fuel passage 22, to hold the valve member 30 at the opening position. By so doing, the content of the auxiliary fuel tank Ts is discharged to the outside of the passage 22 through the normally-opened suction valve 35, inlet port 32, pump chamber 27 and outlet port 33.

Since the suction valve 35 is of the normally-opened type, the pumping operation of the operation rod 25 is not necessary.

As has been described, according to the invention, when the gasoline G as the starting fuel is supplied into the cup-shaped member 20, the mixture fuel consisting mainly of gasoline G is concentrated to the area around the opening of the primary jet 11 which communicates with the primary nozzle 9 and the idle and by-pass ports 7,8, whereas the mixture fuel of the alcoholic fuel and gasoline is stored in the area around the opening of the secondary jet 12 which is connected to the secondary nozzle 10.

It is, therefore, possible to start up the engine by an efficient use of a comparatively small amount of gasoline G even when the ambient temperature is comparatively low. In addition, the fuel supply is smoothly shifted from the primary nozzle 9 to the secondary nozzle 10 to ensure a smooth and safe transient operation after the start up to the loaded operation, with an extremely small consumption of the gasoline G.

What is claimed is:

1. In a carburetor including an intake bore having a venturi portion therein, a throttle valve disposed in said intake bore at the downstream side of said venturi portion, a primary nozzle opening to a portion of said intake bore between said throttle valve and said venturi portion, and a secondary nozzle opening to said venturi portion, said primary nozzle and said secondary nozzle being in communication with a float chamber through a primary jet and a secondary jet, respectively;

an improvement which comprises: a slow fuel passage shunting from a portion between said primary nozzle and said primary jet, said slow fuel passage being communicated with an idle port and a by-pass port both of which open to said intake bore in the vicinity of said throttle valve; a cup-shaped disposed beneath the level of the fuel in said float chamber and defining therein a downwardly opened space, said primary jet opening to an uppermost portion of the space in said cup-shaped member while said secondary jet opening to an intermediate portion of the space in said cup-shaped member; a main fuel tank storing an alcoholic fuel therein and communicating with said float chamber through a float chamber; and an auxiliary fuel tank storing gasoline therein and communicating with the space in said cup-shaped member through a metering pump.

* * * * *